US006129323A

United States Patent [19]

Mandokoro et al.

[11] Patent Number: 6,129,323

[45] Date of Patent: Oct. 10, 2000

[54] SHEET STAND

[75] Inventors: Kenjiro Mandokoro; Yoko Mandokoro, both of Tokyo, Japan

[73] Assignee: Daishin Kohsan Co., Ltd., Tokyo, Japan

[21] Appl. No.: 09/252,089

[22] Filed: Feb. 18, 1999

[30] Foreign Application Priority Data

Aug. 31, 1998 [JP] Japan ..... 10-245609

[51] Int. Cl.[7] ..... A47B 97/04; A47B 19/00; A44B 1/04; A47G 1/16

[52] U.S. Cl. ..... 248/453; 24/67 R; 40/761; 248/441.1

[58] Field of Search ..... 248/453, 459, 248/441.1, 473, 316.2, 316.3, 211, 451, 450; 211/45; 24/545, 67 R; 40/120, 650, 761, 764, 146

[56] References Cited

U.S. PATENT DOCUMENTS

| | | | |
|---|---|---|---|
| 5,775,663 | 7/1998 | Fitzsimmons et al. | 248/450 |
| 5,857,654 | 1/1999 | Berman | 248/441.1 |
| 5,911,398 | 6/1999 | VanLandingham, Jr. | 248/441.1 |

FOREIGN PATENT DOCUMENTS

| | | | |
|---|---|---|---|
| 168124 | 10/1956 | Australia | 40/650 |
| 2451491 | 11/1980 | France | 248/316.3 |
| 09118090 | 5/1997 | Japan . | |
| 10114182 | 5/1998 | Japan . | |
| 365349 | 1/1932 | United Kingdom | 40/146 |
| 629377 | 9/1949 | United Kingdom | 248/316.3 |

*Primary Examiner*—Ramon O. Ramirez
*Assistant Examiner*—Jon Szumny
*Attorney, Agent, or Firm*—Arent Fox Kintner Plotkin & Kahn, PLLC

[57] ABSTRACT

A sheet stand which stands a sheet, such as a piece of paper, with a simple operation. The sheet stand includes the sheet stand body 20 and the ball 30. The bottom of the sheet is held between the curved holding surface 21 of the sheet stand body 20 and the ball 30. Then, the ball 30 moves toward the curved surface 24 at the holding surface 21 by its own self-weight, thereby grabbing the bottom of the sheet bending the bottom portion inside to make the sheet firmer to stand.

9 Claims, 7 Drawing Sheets

SHEET STAND

BACKGROUND OF THE INVENTION

This invention relates to a sheet stand for holding different kinds of sheet material, each of which may be difficult to stand in a standing position. Such sheet material can include a piece of paper, a memo, a picture, a poster, a painting, a recipe, a menu, or the like.

Traditionally, some devices exist to enable a thin sheet to stand. The thin sheet material tends to bend easily. However, most of the existing devices have problems of size because the sheet supporting device usually includes a plate which is larger than a sheet to be held. Conventional devices also have a problem with the necessity of having a clip at their top to hold the top of the sheet.

Such conventional devices to stand a thin sheet require a larger and unnecessary space for setting them up. Since the size must be larger, the devices cost more. In addition, the devices require additional parts such as a clip, which may be troublesome.

SUMMARY AND OBJECTS OF THE INVENTION

This invention is provided to resolve the problems above. More specifically, an object of this invention is to provide an easy to operate, simple device to stand many different kinds of sheets.

It is another object of the present invention to provide a sheet stand which is easy and relatively inexpensive to manufacture.

It is a further object of the present invention to provide a sheet stand that takes up little additional room and does not require many additional parts.

To fulfill these objects and many others which would be apparent to those skilled in the art upon review, the present invention is a sheet stand, which holds a lower portion of a sheet and causes the sheet to stand upright, wherein a standing curved surface supports the lower back surface of the sheet, a ball is placed in front of the standing curved surface, a central region of the lower portion of the sheet is curved between the standing curved surface and the ball, and the ball presses the lower portion of the sheet.

The present invention also can be a sheet stand, which holds a lower portion of a sheet and causes the sheet to stand upright, wherein the sheet stand comprises a sheet stand body equipped with a holding surface which holds a lower back surface of the sheet and a ball placed facing the holding surface of the sheet stand body. The sheet stand body includes the holding surface which holds the lower back surface of the sheet, a support surface which is inclined to support the holding surface, a curled surface wherein the ball is placed between the curled surface and the holding surface, and a curved surface on the holding surface, wherein a central region of the lower portion of the sheet is curved when placed between the holding surface and the ball, and the curved surface is shaped so that the ball inside of the curled surface tends to roll toward the curved surface of the holding surface by the ball's own weight.

The present invention can also be a sheet stand as above, wherein an inner bottom curved surface at the curled surface is curved downwardly toward the end of the curved surface at the holding surface, and the curved surface at the curled surface presses the ball toward the curved surface at the holding surface.

The present invention can also be a sheet stand as above, wherein a guide rail is formed horizontally across on an inner bottom curved surface at the curled surface, the ball is placed on the guide rail, and a weight of the ball rests on the curved surface at the holding surface.

The present invention can also be a sheet stand as above, wherein a horizontal line groove is formed on the curved surface at the curled surface, the ball is installed between the line groove and the curved surface at the holding surface, and the self-weight of the ball on the line groove is on the curved surface at the holding surface.

The present invention can also be a sheet stand as above, wherein the ball is supported on a flexible device, and the flexibility of the flexible material is utilized to press the ball toward the curved surface at the holding surface.

The present invention can also be a sheet stand as above, wherein a post stands toward the curved surface at the holding surface. Inclined rings, which cross each other, are formed on top of the post and the ball is loosely positioned inside the rings with portions of the ball exposed from the rings, being pressed toward the curved surface at the holding surface.

The present invention can also be a sheet stand as above, wherein a curve of the ball is sharper than the surface at the holding surface.

The invention can also be a sheet stand, which holds a lower portion of a sheet and supports the sheet, wherein the sheet stand comprises a sheet stand body equipped with a holding surface which holds a lower back surface of the sheet and a ball placed facing the holding surface of the sheet stand body, and the sheet stand body comprises the holding surface which holds the lower back surface of the sheet, a support surface which is inclined to support the holding surface, a curled surface wherein the ball is placed between the curled surface and the holding surface, and a curved surface on the holding surface, wherein the ball rolls toward the holding surface by its weight to hold the sheet between the ball and the holding surface.

The present invention can also be a sheet stand as above, wherein the supporting surface is designed to be hung or fixed on the wall.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS OF THE INVENTION

Figure 2:
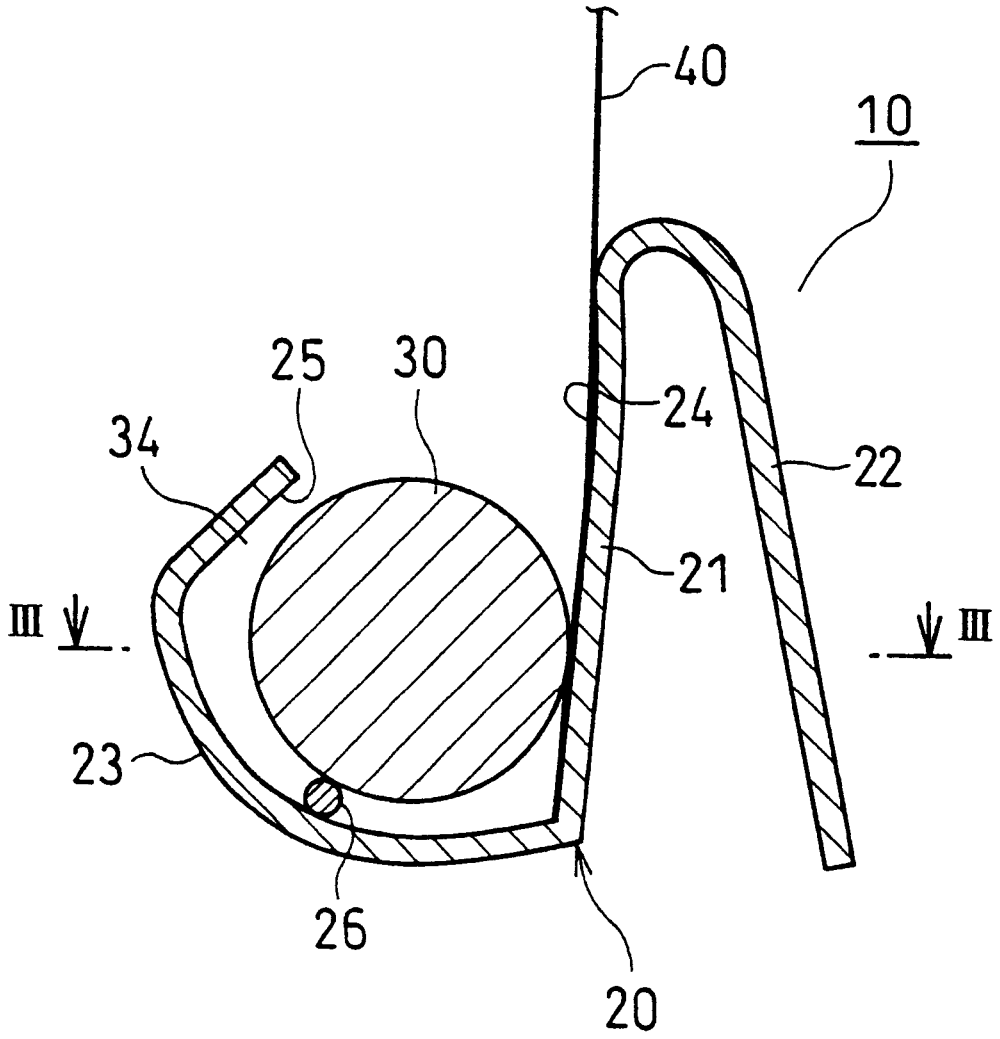
FIG. 2 is a cross-section view of the center of the sheet stand of FIG. 1.
Figure 3:
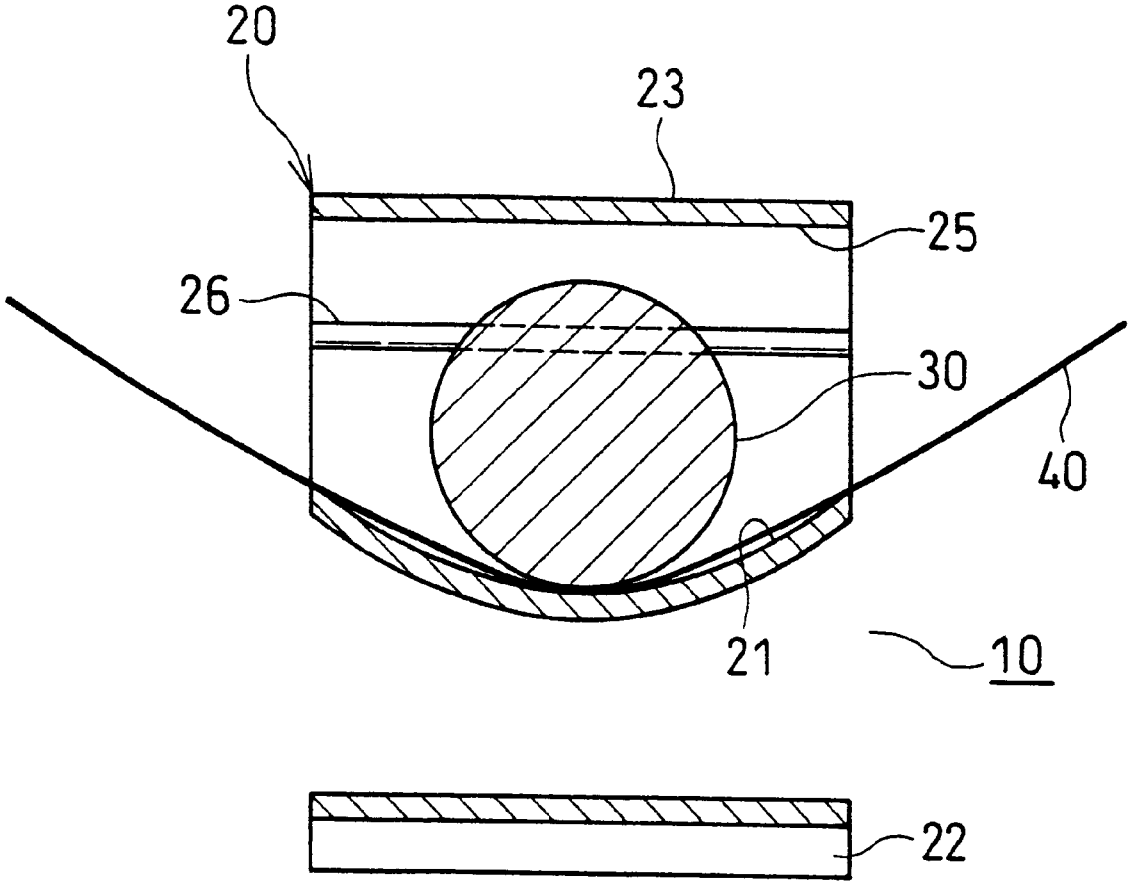
FIG. 3 is a cross-section view of FIG. 2 taken along the line 3—3.

Embodiments of this invention are explained with reference to the following FIGS. 1–3. Like reference numerals refer to like parts throughout the several views of the drawings.

Figure 1:
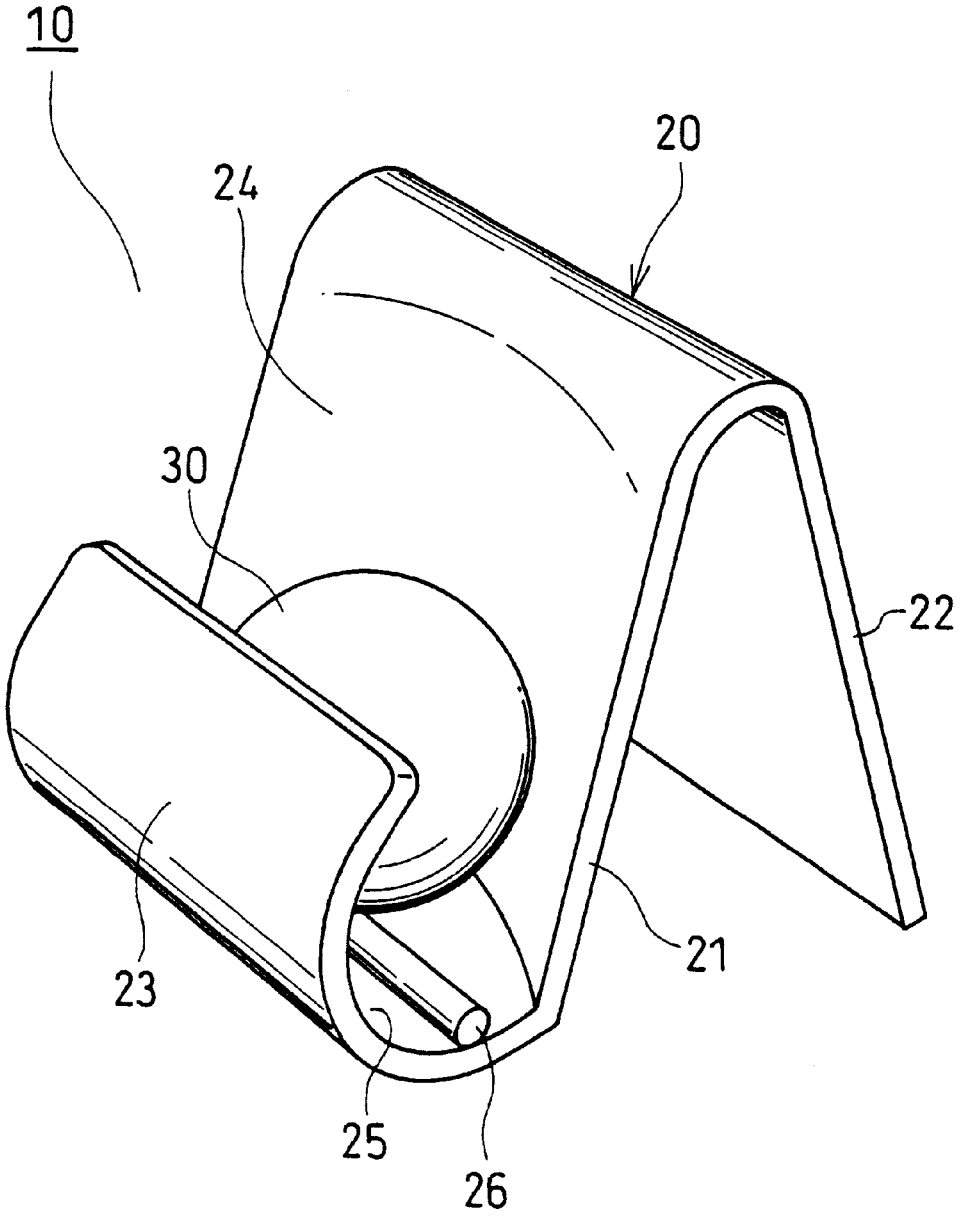
FIG. 1 is an isometric view of the sheet stand of a first embodiment of this invention.

FIG. 1 shows a first example of the sheet stand 10 of the present invention. The sheet stand 10 comprises a sheet stand body 20 and a ball 30. The sheet stand is designed to hold a lower portion of the sheet. The lower portion of the sheet to held is curved. The following are explanations of the respective parts.

The sheet stand body 20 comprises the holding surface 21 to support the lower back surface of the sheet 40, a support surface 22 supporting the inclined holding surface 21, and a curled surface 23 for the installation of the ball 30 in combination with the holding surface 21.

In this embodiment, a single plate of a clear plastic material is bent to form a reverse-N shape. The holding surface 21, the supporting surface 22, and the curled surface 23 are made from this one plate. However, the respective surfaces 21, 22, 23 may be made from separate parts.

A curved surface 24 is formed by bending both sides (edges) of the holding surface 21 toward the curling surface 23. This makes a trough in the center of curved surface 24. A curve of the curved surface 24 is larger than the curvature of the ball 30. The trough extends in the vertical direction on the curved surface 24 as is plainly evident from the view in FIG. 3.

From a lower portion of the holding surface 21, the plastic plate is curled up to form the curled surface 23. A front curved surface 25 is horizontally formed at the inner surface of the curled surface 23.

A clearance between the end of the curled surface 23 and the holding surface 21 is made smaller than the diameter of the ball 30 so that the ball 30 can not easily be removed from the clearance between the end of the curled surface 23 and the holding surface 21.

A rail 26 is horizontally formed on the inner bottom surface of the curled surface 23. The rail 26 is located at a position more toward the curled surface than an imaginary perpendicular, vertical line passing through the center of the ball 30, i.e. in the direction of departing from the curved surface 24, when abutting the ball 30 against the curved surface 24 at the holding surface 21. The purpose of forming the rail 26 is to always energize the weight of the ball 30 toward the curved surface 24 at the holding surface 21 and to reduce a frictional resistance of contacting the ball 30.

Further, as shown in the Figures, the rail 26 may be a rod-like member and may be fixed on the curling surface 23. Alternatively, one portion of the plate material used as the curling surface may be bent to function as the rail by protruding inside the space where the ball 30 is placed.

In addition, the rail 26 is not always a necessary part of the sheet stand body 20 and can be omitted. In that case, by increasing the decline of the curved surface 25 at the curled surface 23 contacting with the ball 30, a portion of the curved surface 25 may be substituted for the rail 26.

The ball 30 is the energizing device to press the bottom of the sheet 40 to bend the sheet as well as a weight to maintain the stability of the sheet stand 10 by providing an appropriate weight on the light sheet stand body 20. For example, a relatively weighty material can be used for the ball, such as glass, copper, and resin.

The ball 30 is supported by contacting a part of its circumferential surface with the rail 26 of the curled surface 23 and the curved surface 24 at the holding surface 21.

Since the curved surface 24 is curved relative to the straight rail 26, even if the ball 30 is forced to move, the ball 30 stably stays on the center of the rail 26 because of its self-weight. By employing a swing method of returning the ball 30 to the center, this sheet stand adds a play factor to its original function of standing the sheet 40.

In addition, there is a slight clearance 34 between the ball 30 and the curved surface 25 of the curling surface 23. The thickness of a sheet or sheets which may be placed on this sheet stand by moving the ball 30 away from the curved surface 24 at the holding surface 21 depends upon the size of the clearance 34.

An operation of the sheet stand 10 is explained next.

FIG. 1 illustrates the sheet stand 10 before any sheet is set on it, where the ball 30 is supported its circumferential surface by the rail 26 at the curling surface 23 and rests against the curved surface 24 at the holding surface 21. Under this condition, when the sheet stand 10 is shaken, the ball 30 may rock and roll left and right for some time. The rolling becomes smaller and the ball stops at the center of the rail 26.

When standing a thin sheet 40 in the stand which is larger the sheet stand 10, all that is required to stand the sheet 40 is to place the bottom portion of the sheet 40 between the holding surface 21 and the ball 30, i.e., the sheet 40 being placed between the ball 30 and the holding surface 21 pushes the ball 30 back toward the curling surface 23, thereby securing a sufficient space between the ball 30 and the holding surface 21.

When the sheet 40 is inserted between the ball 30 and the holding surface 21, the center of the front surface of the sheet 40 is pushed toward the curved surface 24 by the weight of the ball 30. The back surface of the sheet 40 is bent toward and along the curved surface 24.

For instance, the condition of the standing sheet 40 is similar to holding the back bottom surface of the sheet 40 with four fingers without a thumb and holding the front bottom center surface of the sheet 40 with the thumb.

By gently bending a center of the entire sheet 40, the sheet 40 becomes stiffer, and the sheet 40 does not fall even without a back support along its entire length to maintain its standing.

In addition, the ball 30 may roll horizontally on the curved surface 24, and another sheet 40 may be added just by inserting the additional sheet 40 and bending it in the same manner as the previous sheet. Still further sheets 40 may be added until the ball 30 abuts against the curved surface 25 at the curling surface 23.

The sheet 40 is held only by the weight of the ball 30; therefore, the sheet 40 may be removed just by pulling it from the sheet stand 10. Accordingly, when inserting or removing a sheet 40, simply inserting or removing the sheet 40 between the ball 30 of the sheet stand 10 and the curved surface 24 may be sufficient.

A second embodiment of this invention is explained next. Those components which are the same as in the first embodiment are identified by the same numbers and an explanation thereof is omitted here.

Figure 4:
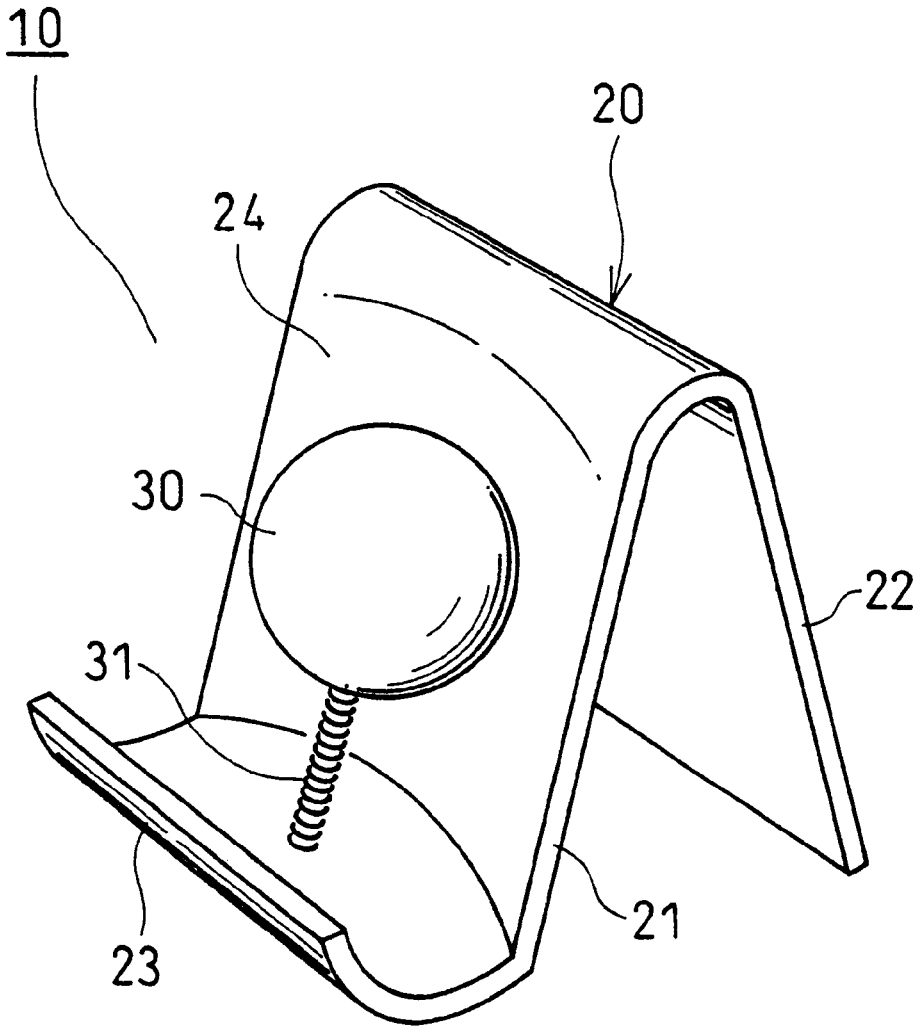
FIG. 4 is an isometric view of the sheet stand in a second embodiment of this invention where a flexible device is used to energize the ball.

In FIG. 4, a second embodiment is shown where a flexible device 31 such as a coil spring may support the ball 30. The flexibility of the flexible device 31 is utilized to energize the ball 30 to abut against the curved surface 24 at the holding surface 21.

Figure 5:
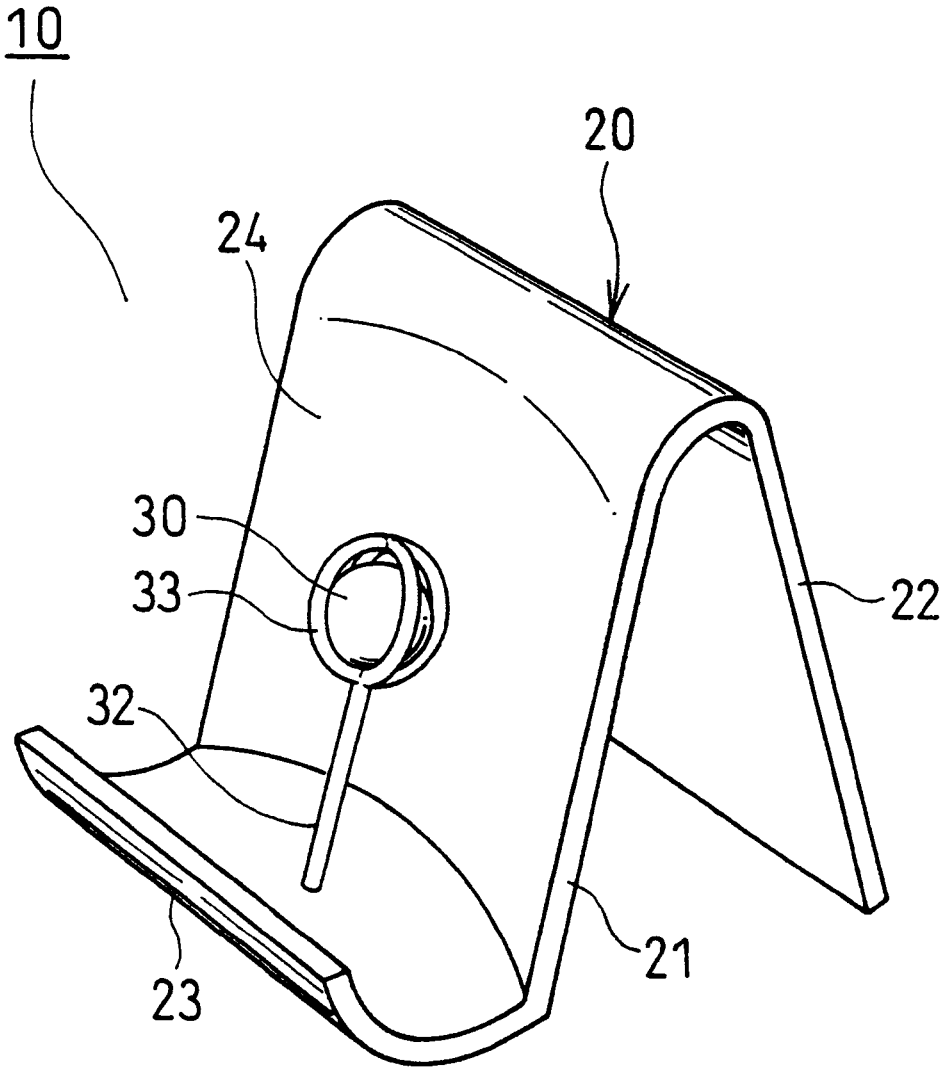
FIG. 5 is an isometric view of the sheet stand in a third embodiment of this invention where a supporting post is used to energize the ball.

In FIG. 5, a third embodiment is shown where plural rings 33 are crossed on the top of the supporting post 32 which stands on surface 23 at an incline. The ball 30 is placed inside the rings, and the sheet, not shown in the diagram, is held at the curved surface 24 by a part of the ball 30 which is exposed from the rings.

Figure 6:
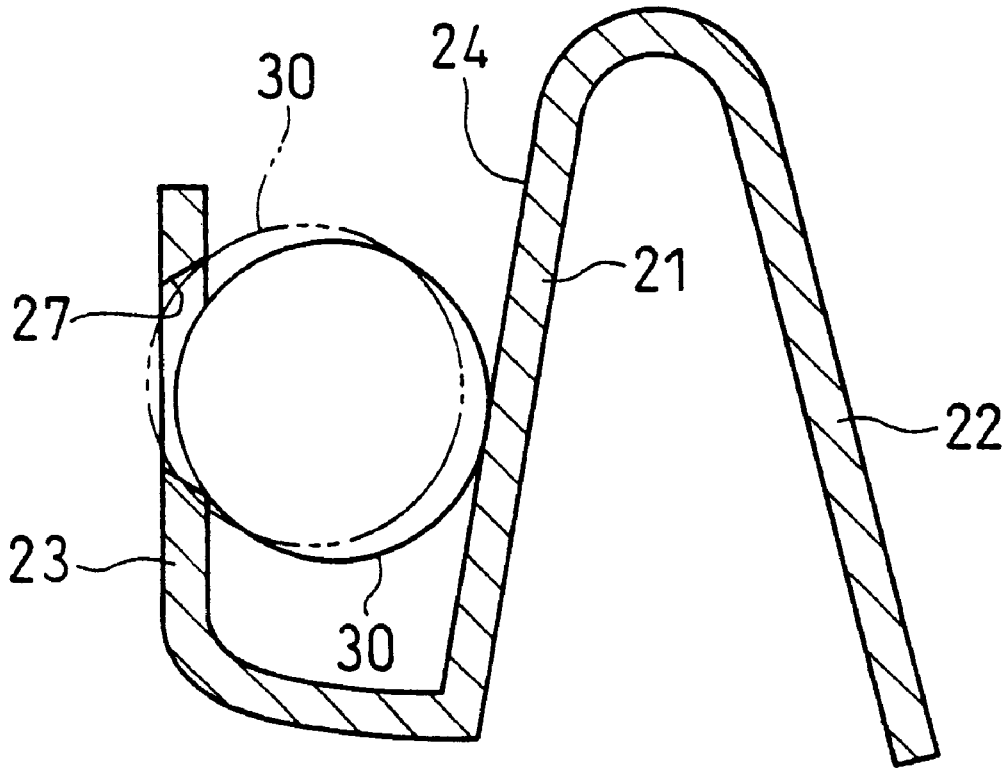
FIG. 6 is a cross-section view of the center of the sheet stand of a fourth embodiment having a line groove formed on the curled surface.

Further, as a means to abut the ball 30 against the curved surface 24 at the holding surface 21, a fourth embodiment is shown in FIG. 6. The ball 30 is placed between a horizontal line groove or slot 27 formed in the incline surface of the curling surface 23 and the curved surface 24 at the holding surface 21. The ball 30 rests on the lower part of the line groove 27 by its self-weight. When the sheet is inserted, the ball 30 may be pushed deeper into the groove 27 as shown by the two chain lines.

In the above explanation, in order to stand the sheet 40, the sheet is bent inside by the curved surface 24 at the holding surface 21 and the ball 30.

Figure 7:
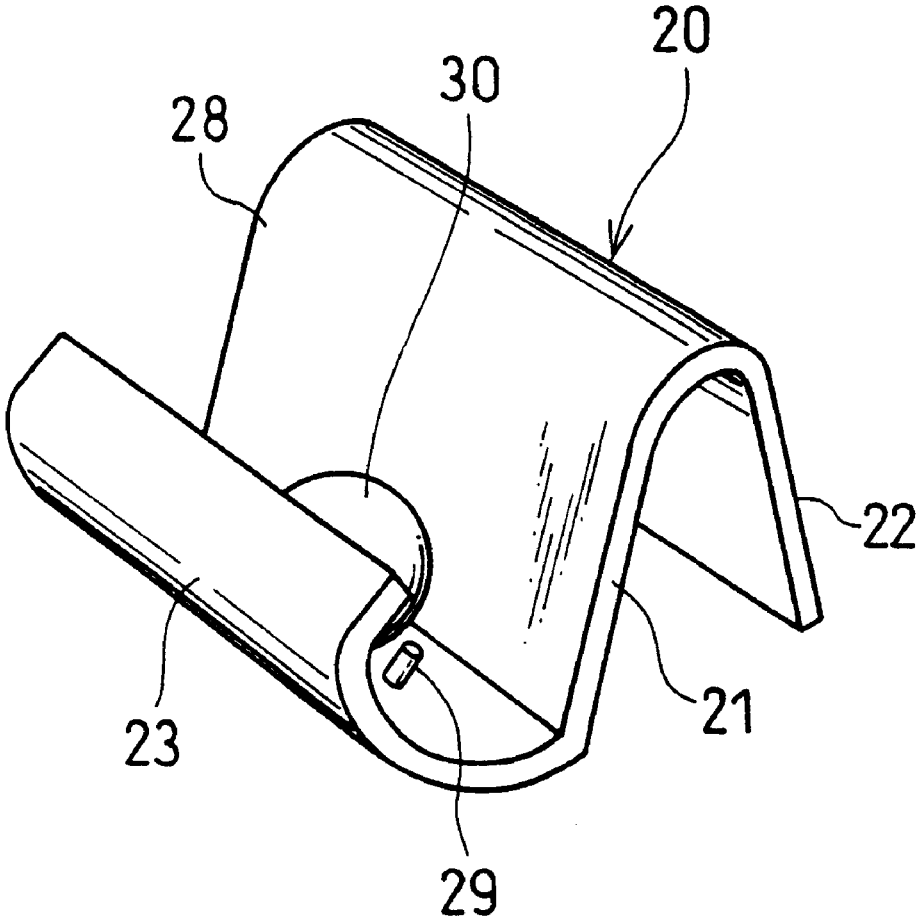
FIG. 7 is an isometric view of the sheet stand in a fifth embodiment of this invention where the holding surface is a flat surface.

FIG. 7 illustrates a fifth embodiment when the surface of the holding surface 21 is a flat surface 28, i.e., it is not curved. In this example, the ball 30 abuts against the holding surface 21 by using the incline of the curved surface 25 at the flat surface 28, and the sheet is grabbed between the ball 30 and the flat surface 28.

This example is suitable for standing a sheet having a certain self-stiffness or hardness such as a picture or a post card. In addition, protuberances 29 are located at the bottom inner side of the curling surface 23 and are provided at both sides of the ball 30. The pair of the protuberances 29 restrict the horizontal movement of the ball 30.

The sheet stand 10 of this invention as illustrated is to be placed on a table or desk. However, the supporting surface 22 may include a hook to be hooked somewhere or some other fixing device such as a pin or adhesives may be used to enable the sheet stand to be fixed on a wall, a computer monitor, or the like. In addition, any other publicly known fixing or hooking device may be used to secure the present invention where it is desired.

This invention has the following advantages.

The bottom back surface of the sheet stands and is supported at the curved surface. The ball placed in front of this curved surface pushes the bottom front side of the sheet toward the curved surface. This provides a firmer sheet stand.

Accordingly, even if a sheet to be stood is taller than the sheet stand, this invention provides a sheet stand that stably stands the sheet.

A sheet may directly be inserted or removed from between the ball and curved surface, and this simple method enables to firmly stand the sheet.

The ball may move forward toward or backward from the curved surface. Thus, this invention is very flexible in that the sheet stand may hold a thicker sheet or a plural number of sheets.

Since a bottom part of the sheet is grabbed, the size of the sheet stand may be designed smaller, thereby not occupying unnecessary space.

The ball is designed to be moveable, and this sheet stand adds a play factor to its original function of standing the sheet. This increases a value of the sheet stand.

The sheet stand of the invention may hold different sizes or materials of the sheet.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What we claim is:

1. A sheet stand for holding a lower portion of a sheet and for supporting the sheet, the sheet stand comprising a sheet stand body having a holding surface adapted to hold a lower back surface of the sheet, a support surface extending downwardly from a top edge of said holding surface and inclined to support the holding surface, and a curled surface extending upwardly from a bottom edge of said holding surface, the holding surface including a curved surface; and a ball placed facing the holding surface of the sheet stand body, wherein the ball is placed between the curled surface and the holding surface, and the curved surface is shaped so that the ball inside of the curled surface tends to roll toward the curved surface of the holding surface by the weight of the ball whereby a central region of the lower portion of the sheet is curved when placed between the holding surface and the ball.

2. A sheet stand as claimed in claim 1, wherein an inner bottom curved surface of the curled surface is curved downwardly toward an end of the curved surface of the holding surface, and the curved surface of the curled surface presses the ball toward the curved surface of the holding surface.

3. A sheet stand as claimed in claim 1, wherein a guide rail is formed horizontally across on an inner bottom curved surface of the curled surface, the ball being placed on the guide rail, and the weight of the ball rests on the curved surface of the holding surface.

4. A sheet stand as claimed in claim 1, wherein a horizontal line groove is formed in the curved surface of the curled surface, the ball is positioned between the line groove and the curved surface of the holding surface, and the weight of the ball on the line groove is on the curved surface of the holding surface.

5. A sheet stand as claimed in one of claim 1, wherein the ball is supported on a flexible device, and the flexibility of the flexible device is utilized to press the ball toward the curved surface of the holding surface.

6. A sheet stand as claimed in one of claim 1, wherein a post stands toward the curved surface of the holding surface at an incline, plural rings crossing each other are attached top of the post, the ball is loosely positioned in the rings with portions of the ball exposed from the rings being pressed toward the curved surface of the holding surface.

7. A sheet stand as claimed in one of claims 1, wherein the curvature of the ball is sharper than the curved surface of the holding surface.

8. A sheet stand for holding a lower portion of a sheet and for supporting the sheet, the sheet stand comprising a sheet stand body having a holding surface for holding a lower back surface of the sheet, a support surface which is extending downwardly from a top edge of said holding surface and inclined to support the holding surface, a curled surface extending upwardly from a bottom edge of said holding surface and a curved surface on the holding surface; and a ball facing the holding surface of the sheet stand body, wherein the ball is placed between the curled surface and the holding surface, and wherein the ball rolls toward the holding surface by its weight for holding the sheet between the ball and the holding surface.

9. A sheet stand as claimed in one of claim 1 or 8, wherein the supporting surface is designed to be hung or fixed on a wall.

* * * * *